US006714131B2

(12) United States Patent
Iwasawa et al.

(10) Patent No.: US 6,714,131 B2
(45) Date of Patent: Mar. 30, 2004

(54) ANTI-THIEF SECURITY SENSOR ASSEMBLY USING THE OPENING OF THE PROJECTOR COVER FOR BEAM ADJUSTMENT

(75) Inventors: Masashi Iwasawa, Otsu (JP); Hiroyuki Ikeda, Otsu (JP); Tsuyoshi Hatano, Otsu (JP); Fumikatsu Sone, Otsu (JP)

(73) Assignee: Optex Co., Ltd., Shiga (JP)

( * ) Notice: Subject to any disclaimer, the term of this patent is extended or adjusted under 35 U.S.C. 154(b) by 0 days.

(21) Appl. No.: 10/251,994

(22) Filed: Sep. 20, 2002

(65) Prior Publication Data

US 2003/0058094 A1 Mar. 27, 2003

(30) Foreign Application Priority Data

Sep. 26, 2001 (JP) ..... 2001-293568

(51) Int. Cl.[7] ..... G08B 13/18

(52) U.S. Cl. ..... 340/556; 340/545.3; 340/556; 340/557; 340/555; 340/567; 340/686.1; 340/687; 250/221; 250/222.1; 250/223 R; 250/223 B

(58) Field of Search ..... 340/545.3, 556, 340/567, 555, 506, 507, 501, 502, 686.1, 687, 545.1; 250/557, 221, 222.1, 223 R, 223 B, 224

(56) References Cited

U.S. PATENT DOCUMENTS 5,812,058 A * 9/1998 Sugimoto et al. ..... 340/556
6,031,456 A * 2/2000 Hanyuda ..... 340/555

* cited by examiner

*Primary Examiner*—Jeffery Hofsass
*Assistant Examiner*—Eric Blount

(57) ABSTRACT

To provide an anti-thief security sensor assembly wherein an optical axis adjustment of a beam projector can be accurately achieved merely by physically opening a cover of a beam projecting unit while a cover of a beam receiving unit is not opened physically, the anti-thief security sensor assembly includes a beam projecting unit (1) for emitting an infrared beam IR and having a projector cover (21A) mounted on a projector base (20A) so as to cover and protect a sensor circuit. This beam projecting unit (1) includes an opening detecting switch (7) for detecting the physical opening of the projector cover (21A) and a transmission request generating circuit (8) operable in response to the detection by the opening detecting switch (7) to output a received beam level transmission request signal B to the beam receiving unit (2). The beam receiving unit (2) for receiving the infrared beam IR from the beam projecting unit 1 includes a level output circuit (52) operable in response to receipt of the received beam level transmission request signal B to transmit to the beam projecting unit (1) a level display signal C indicative of the amount of the infrared beam received by the beam receiving unit (2).

5 Claims, 3 Drawing Sheets

ANTI-THIEF SECURITY SENSOR ASSEMBLY USING THE OPENING OF THE PROJECTOR COVER FOR BEAM ADJUSTMENT

BACKGROUND OF THE INVENTION

1. Field of the Invention

The present invention generally relates to an anti-thief security sensor assembly and, more particularly, to the anti-thief security sensor assembly of a type wherein while an infrared beam emitted from an infrared beam projecting unit is constantly received by an infrared beam receiving unit, an alarm is generated when an unauthorized intruder traverses across the path of travel of the infrared beam from the infrared beam projecting unit towards the infrared beam receiving unit.

2. Description of the Prior Art

The anti-thief security sensor assembly is known in which a beam projector of an infrared beam projecting unit and a beam receiver of an infrared beam receiving unit are installed at opposite ends of a rectilinear guard area spaced an appropriate distance from each other with their optical axes aligned with each other. The infrared beam receiving unit is so operated that when the receiver senses the infrared beam the receiver can output an electric signal of a signal level proportional to the amount of the infrared beam received. The electric signal so outputted is, after having been amplified by an amplifier circuit, processed by a detecting circuit to remove a disturbance light component and then to convert it into a signal of a level proportional to the received beam signal, and the signal level from the detecting circuit is subsequently determined by a signal discriminating circuit as to whether or not the level of the signal is lower than a predetermined detection level. In the event that the level of the received beam signal attains a value lower than the predetermined detection level as a result of the infrared beam from the beam projecting unit towards the beam receiving unit having been intercepted by traverse of an unauthorized intruder, the signal discriminating circuit outputs a detection signal with which an alarm generator is driven to output an alarm signal warning that the unauthorized intruder has entered the guard area.

The anti-thief security sensor assembly is generally capable of monitoring the guard area ranging from a rectilinearly close distance to a rectilinearly long distance of a few hundred meters, and the longer the rectilinear distance, the more difficult it is to install the beam projector and the beam receiver with their optical axes aligned with each other as accurately as possible at respective locations a distance from each other. Accordingly, the conventional anti-thief security sensor assembly includes a sighting instrument so as to facilitate the alignment of the respective optical axes of the beam projecting and receiving units. To align the respective optical axes of the beam projecting and receiving units with each other at the time of installation or servicing of the anti-thief security sensor assembly, a servicing worker has to look through a viewing hole of the sighting instrument mounted on the beam receiving unit to adjust the angle of orientation of the beam receiver in both vertical and horizontal directions to roughly align the respective optical axes of the beam projecting and receiving units with each other with naked eyes. Once this has been done, while the signal level proportional to the amount of the infrared beam received by the beam receiver is read out with the use of a level meter such as, for example, a voltmeter electrically connected with and built in the detecting circuit of the beam receiving unit, the angle of orientation of the beam receiver in the vertical and horizontal directions are finely adjusted to render the reading of the signal level to match with a predetermined level of the infrared beam that ought to be received, thereby completing the job of aligning the respective optical axes of the beam projecting and receiving units.

In recent years, the anti-thief security sensor assembly has come to be known in which the beam receiving unit is provided with a signal output means for outputting a level display signal descriptive of the amount of the infrared beam received to the beam projecting unit and, on the other hand, the beam projecting unit is provided with a receiving means for receiving the level display signal and a display means for displaying the level display signal so received. See, for example, the Japanese Laid-open Patent Publication No. 4-71099. According to this prior art anti-thief security sensor assembly, the fine alignment of the respective optical axes of the beam projecting and receiving units is carried out by manipulating the sighting instrument of the beam projecting unit while the display of the level display signal received from the receiving means is monitored with naked eyes. While the optical adjustment on the side of the beam projecting unit had required intervention of at least two servicing workers, assigned respectively to sites of installation of the beam projecting and receiving units, who were required to communicate wireless with each other as to the level of the infrared beam received, this prior art anti-thief security sensor assembly disclosed in the above referenced publication requires only one servicing worker to accomplish a similar optical adjustment.

According to the prior art, difficulty has been encountered that even when the level of the infrared beam being received by the beam receiving unit is desired to be ascertained, no transmission of the level display signal from the beam receiving unit to the beam projecting unit is possible. In other words, transmission of the level display signal from the beam receiving unit to the beam projecting unit is possible only when and after a receiver cover enclosing and protecting the beam receiving unit is physically opened and mere physical opening of a projector cover enclosing and protecting the beam projector does not allow the beam projecting unit to receive the level display signal transmitted from the beam receiving unit. Accordingly, unless those two covers for the beam receiving and projecting units are physically opened, no fine adjustment of the optical axis of the beam projector is possible.

In view of the above, it has hitherto been carried out for a servicing worker to first open the projector cover for the beam projecting unit, then to move to the site of installation of the beam receiving unit to open the receiver cover for the beam receiving unit so that the optical axis of the beam receiving unit can be adjusted in the manner described above, again to move to the site of installation of the beam projecting unit after the adjustment of the optical axis of the beam receiving unit to thereby effect the adjustment of the optical axis of the beam projecting unit, thereafter to return to the site of installation of the beam projecting unit to mount the once opened projector cover onto the beam projecting unit, and finally to again return to the site of installation of the beam receiving unit to mount the once opened receiver cover onto the beam receiving unit, thereby completing the alignment of the respective axes of the beam projecting and receiving units with each other. For this reason, the servicing worker has to make at least one round and half trip between the respective sites of installation of the beam projecting and receiving units. This is indeed a substantial burden on the servicing worker if the guard area extends a substantial distance, accompanied by a substantial length of time required to complete the optical axis alignment.

SUMMARY OF THE INVENTION

In view of the foregoing, the present invention is intended to provide an anti-thief security sensor assembly wherein only physical opening of a projector cover for a beam projecting unit is sufficient to achieve the adjustment of the optical axis of the beam projecting unit relative to that of a beam receiving unit.

In order to accomplish the foregoing object of the present invention, there is provided an anti-thief security sensor assembly including a beam projecting unit for projecting an infrared beam and a beam receiving unit for receiving the infrared beam projected by the beam projecting unit. The beam projecting unit includes a projector base having a sensor circuit mounted thereon and a projector cover detachably mounted on the base for enclosing and projecting the sensor circuit, an opening detecting switch for detecting a physical opening of the projector cover and a transmission request generating circuit operable in response to the detection of the physical opening of the projector cover by the opening detecting switch for outputting a received beam level transmission request signal to the beam receiving unit. The beam receiving unit is provided with a level output circuit operable in response to the received beam level transmission request signal to transmit to the beam projecting unit a level display signal indicative of the amount of the infrared beam received by the beam receiving unit.

With this anti-thief security sensor assembly according to the present invention, when the projector cover is physically opened at the time of installation or servicing of the anti-thief security sensor assembly, the opening detecting switch detects such physical opening of the projector cover and the transmission request generating circuit operates, based on an detecting operation of the opening detecting switch, to transmit the received beam level transmission request signal to the beam receiving unit. Accordingly, when the beam receiving unit receives the received beam level transmission request signal, the level output circuit transmits the level display signal indicative of the amount of the infrared beam received by the beam receiving unit to the beam projecting unit. Thus, regardless of whether a receiver cover enclosing and projecting circuit components of the beam receiving unit is physically opened, i.e., removed, the servicing worker can perform an accurate axis alignment while looking at the level display signal at the site of installation of the beam projecting unit and, therefore, the workability is high.

In a preferred embodiment of the present invention, the transmission request generating circuit is so designed as to superimpose the received beam level transmission request signal on the infrared beam projected from the beam projecting unit. Accordingly, with no need to provide a communicating means for conducting a communication from the beam projecting unit towards the beam receiving unit, the received beam level transmission request signal can be transmitted from the beam projecting unit towards the beam receiving unit.

In another preferred embodiment of the present invention, the beam receiving unit may include an amplifier for amplifying the infrared beam received by the beam receiving unit, and a received beam level suppressing circuit for controlling the amplifier to reduce the received beam level by a predetermined level corresponding to the amount of the infrared beam attenuated or reduced as it passes through the projector cover of the beam projecting unit. This is particularly advantageous in that since even though the projector cover is physically opened or removed, the amount of the infrared beam received by the beam receiving unit can be displayed by the level meter of the beam projecting unit at the same signal level as the signal level attained when the projector cover is mounted, the alignment of the respective optical axes of the beam projecting and receiving units can accurately be achieved.

It is to be noted that the term "physical opening" used in connection with the projector and receiver cover in the description made hereinabove and hereinafter is intended not only to mean that the cover is removed away from the associated base, but also to mean that the cover is hingedly opened relative to the associated base to which it is hinged and is thus used in the sense that when the cover is opened, internal component parts covered and projected by such cover are rendered open to the outside regardless of whether the cover remains hingedly affixed to the associated base or whether it be separated from the associated base.

BRIEF DESCRIPTION OF THE DRAWINGS

In any event, the present invention will become more clearly understood from the following description of a preferred embodiment thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

Figure 1:
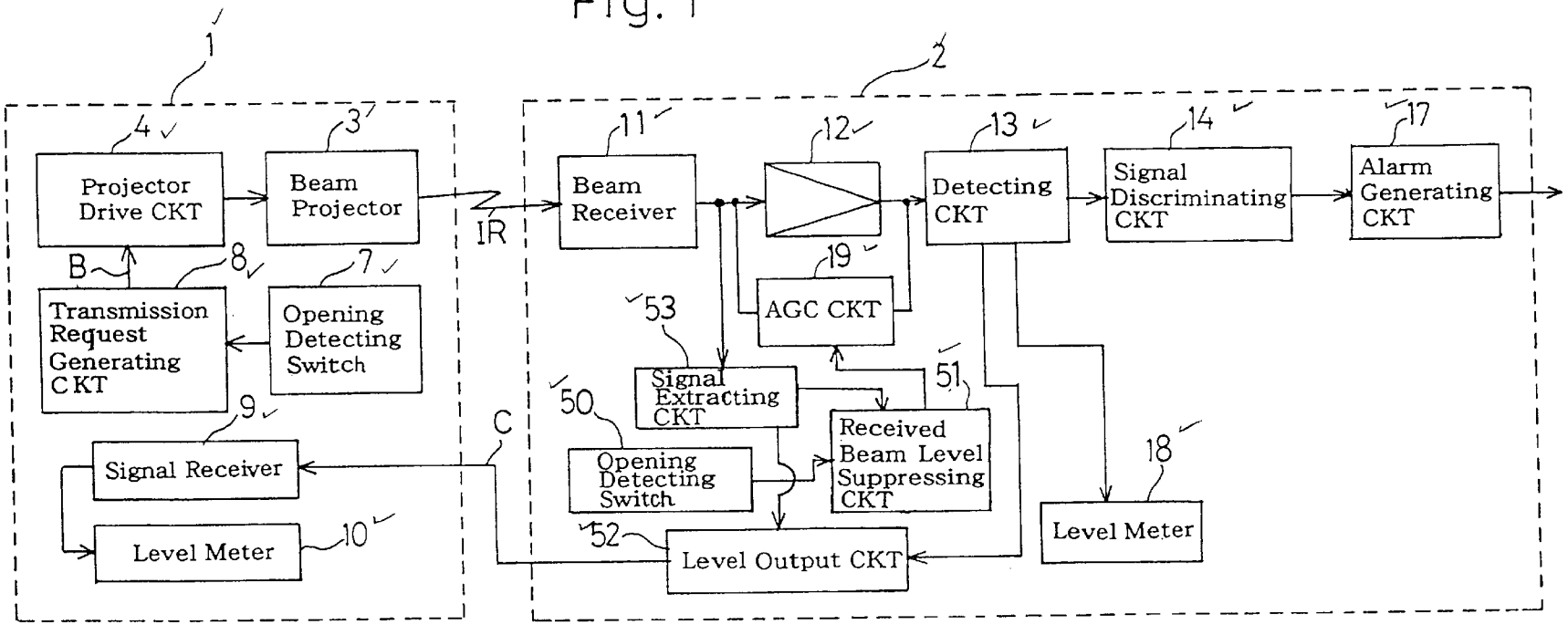
FIG. 1 is a circuit block diagram showing an anti-thief security sensor assembly according to a preferred embodiment of the present invention.

Hereinafter, an anti-thief security sensor assembly according to a preferred embodiment of the present invention will be described in detail. Referring first to FIG. 1 showing a circuit block diagram of the anti-thief security sensor assembly, the anti-thief security sensor assembly includes a beam projecting unit 1 and a beam receiving unit 2 fixedly mounted on corresponding wall surfaces or support poles, which are positioned at opposite ends of a rectilinear guard area spaced an appropriate distance from each other, with their optical axes aligned with each other. Each of the beam projecting and receiving units 1 and 2 is unitarized into a respective module.

Figure 2A:
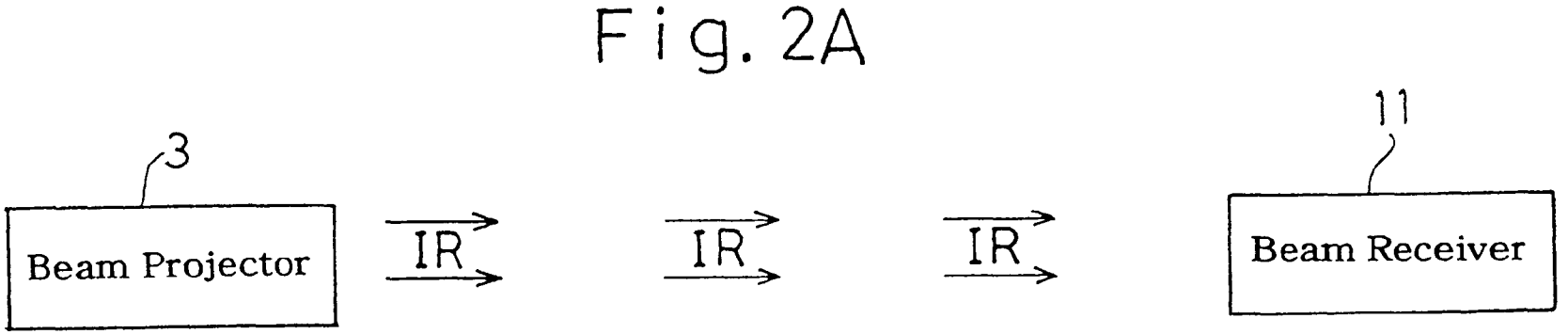
FIGS. 2A and 2B are schematic diagrams showing respective manners of transmission of an infrared beam, a received beam level transmission request signal and a level display signal in the embodiment shown in FIG. 1.

The beam projecting unit 1 includes a beam projector 3 which includes a light emitting element such as, for example, an infrared light emitting diode, and a transmission side optics such as, for example, a beam projecting lens or a reflecting mirror for forming an infrared beam IR. A projector drive circuit 4 is used to drive the light emitting element of the beam projector 3 to cause the latter to emit an infrared beam IR at a predetermined frequency as shown in FIG. 2A. The beam projector 3 and the projector drive circuit 4 forming respective components of a sensor circuit are utilized in a pair as will become clear from the subsequent description, but only one of the pair is shown in FIG. 1.

Figure 2B:
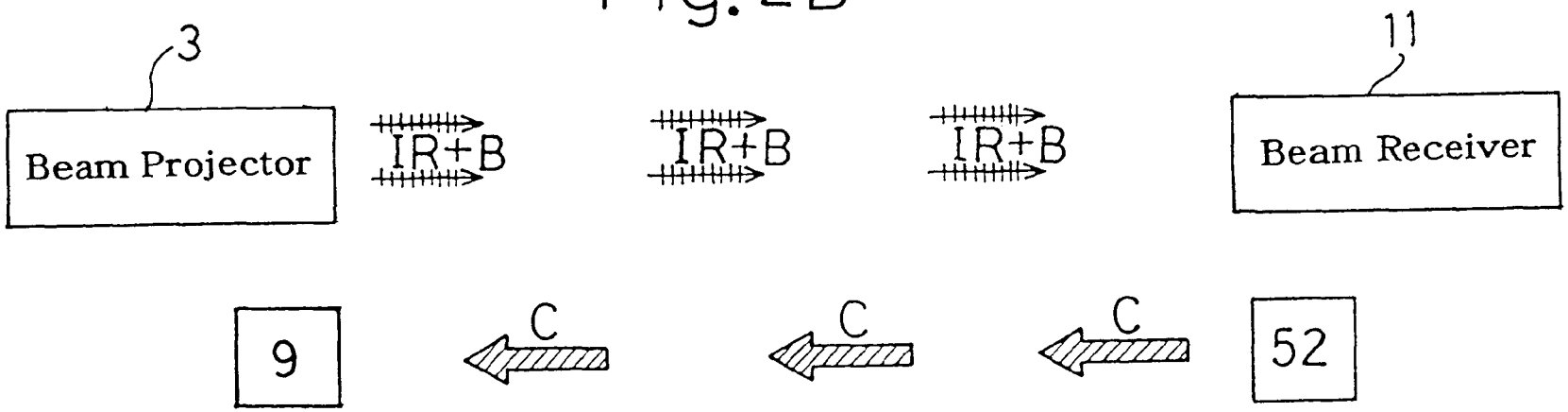

A projector-side opening detecting switch 7 is a contact type or proximity type switch for detecting opening or closure of a projector cover 21A, as will be described later, relative to a projector base 20A. This projector-side opening detecting switch 7 concurrently serves as an existing damper switch utilized to detect a nuisance opening of the projector cover and then to output an alarm signal. A transmission request generating circuit 8 controls, when the opening detecting switch 7 is turned off as a result of detection of the opening of the projector cover 21A, to output a received beam level transmission request signal B to the projector drive circuit 4, then to superimpose it on the infrared beam IR generated from the light emitting element and finally to transmit the resultant superimposed signal IR+B to the beam receiver 11 as shown in FIG. 2B. The beam projecting unit 1 shown in FIG. 1 also includes a signal receiving unit 9 for receiving a level display signal C transmitted from a beam receiving unit 2, and a level meter 10 for displaying a signal level of the level display signal C received by the signal receiving unit 9. It is to be noted that the infrared beam IR is in the form of, for example, a pulse modulated light and the received beam level transmission request signal B is in the form of a pulse signal different in frequency from that of the infrared beam IR.

On the other hand, the beam receiving unit 2 includes a beam receiver 11 made up of a receiver optics such as, for example, a beam receiving lens or a beam receiving mirror, and a light receiving element such as, for example, a phototransistor. This beam receiver 11 is operable to receive the infrared beam IR projected from the beam projecting unit 1 and then to output an electric signal of a signal level proportional to the amount of the infrared beam IR received thereby. This electric signal is, after having been amplified by an amplifier circuit 12, fed to a detecting circuit 13 where the electric signal is, after a disturbance light component contained in the electric signal has been removed, converted into a signal of a level proportional to the level of the received beam signal solely in the form of a pulse modulated wave, which signal level is subsequently determined by a signal discriminating circuit 14 as to whether or not the signal level is lower than a predetermined detection level. In the event that the level of the received beam signal attains a value lower than the predetermined intrusion detection level as a result of the infrared beam IR from the beam projecting unit 1 having been intercepted by traverse of an unauthorized intruder, the signal discriminating circuit 14 outputs a detection signal with which an alarm generating circuit 17 is driven to output an alarm signal warning that the unauthorized intruder has entered the guard area. This alarm signal may be utilized in numerous way and may be communicated to a security center (not shown) and/or utilized to trigger an alarm and/or a lighting instrument on.

A level meter 18 such as, for example, a voltmeter is electrically connected with the detecting circuit 13 so that the signal level proportional to the amount of the infrared beam received by the beam receiver 11 can be displayed by the level meter 18. The amplifier 12 referred to above is gain-controlled by an AGC (automatic gain control) circuit 19 in dependence on the level of the signal received from the beam receiver 11 so that an output from the amplifier circuit 12 can be controlled to a value lower than a predetermined signal level at all times. It is to be noted that the beam receiver 11, the amplifier circuit 12, the detecting circuit 13 and the alarm generator circuit 17 forming respective components of the sensor circuit are also utilized in a pair as will become clear from the subsequent description, but only one of the pair is shown in FIG. 1.

The beam receiving unit 2 also includes a receiver-side opening detecting switch 50, a received beam level suppressing circuit 51, a level output circuit (an level output unit) 52 and a signal extracting circuit 53. The signal extracting circuit 53 outputs a detection signal when the received beam level transmission request signal B is extracted from the signal received by the beam receiver 11. The receiver-side opening detecting switch 50 may be a contact type or proximity type switch for detecting the opening and closure of a receiver cover 21, as will be described later, relative to a receiver base 20 and concurrently serves as an existing damper switch utilized to detect a nuisance opening of the receiver cover 21. The level output circuit 52 is operable, when the detection signal is inputted thereto from the signal extracting circuit 53, to output either by wireless or through a signal feed line a signal level from the detecting circuit 13 as a level display signal C indicative of the amount of the infrared beam received by the receiving unit 2 to a signal receiver 9 included in the beam projecting unit 9.

The received beam level suppressing circuit 51 controls, when the receiver-side opening detecting switch 50 is turned off in response to detection of the opening of the receiver cover 21 or when the detection signal is inputted from the signal extracting circuit 53, to lower the gain of the amplifier circuit 12 through the AGC circuit 19 and then to amplify the signal level of the received beam signal from the beam receiver 11 by lowering such signal level by a predetermined level corresponding to the amount of the infrared beam attenuated (for example, 30%) as it pass through the cover of one of the beam projecting unit 1 and the beam receiver 11. The received beam level suppressing circuit 51 also controls, when the receiver-side opening detecting switch 50 is turned off and the detection signal is inputted from the signal extracting circuit 53, to amplify the signal level of the received beam signal from the beam receiver 11 by lowering such signal level by a quantity con-esponding to the amount of the received infrared beam attenuated (for example, 60%) as it passes through the projector and receiver covers.

Figure 3:
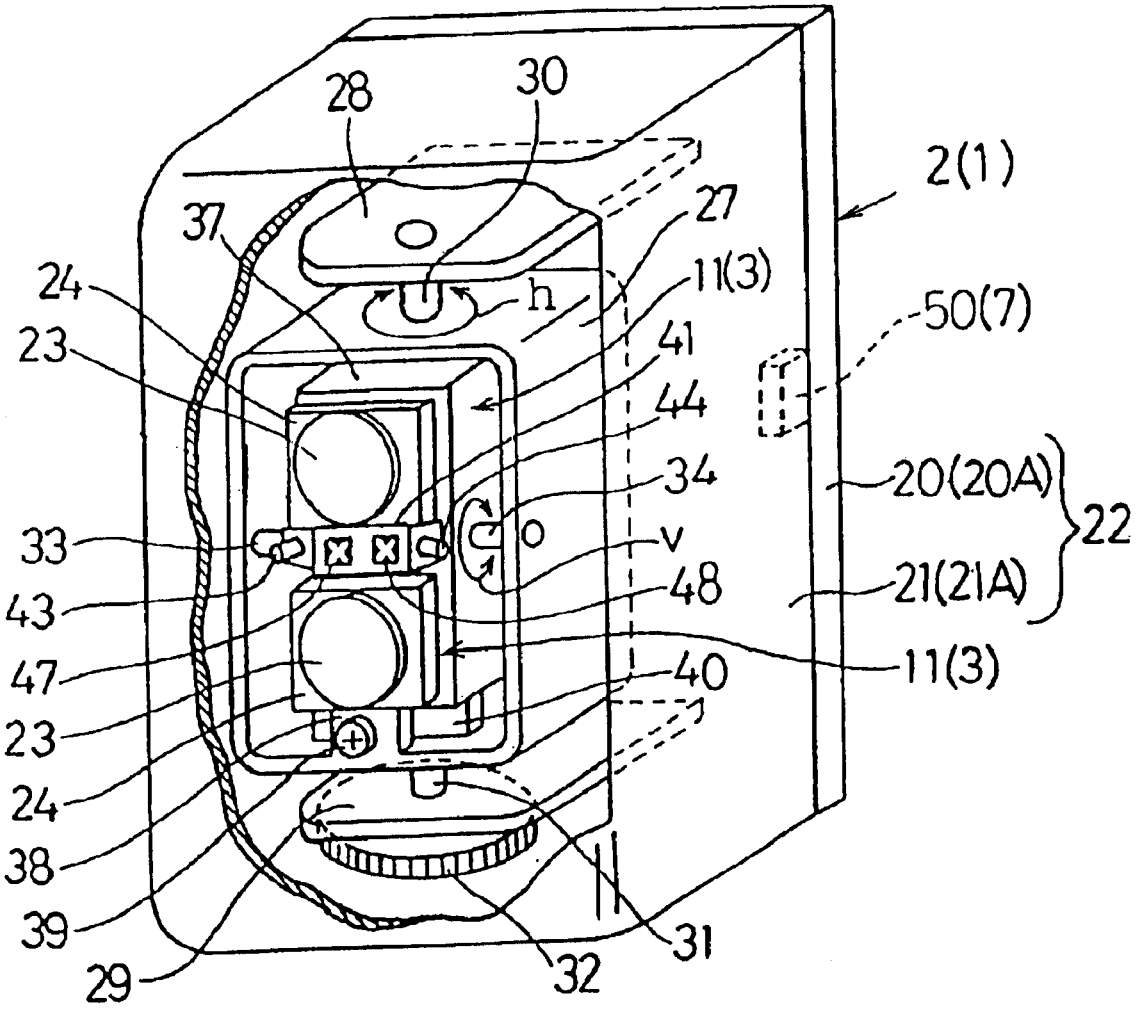
FIG. 3 is a schematic perspective view showing the anti-thief security sensor assembly shown in FIG. 1, with a portion of a beam receiving unit shown as cut out.

FIG. 3 illustrates the beam receiving unit 2 with a portion thereof cut out. It is to be noted that since the beam projecting unit 1 is of a structure substantially similar to that of the beam receiving unit 2 and, accordingly, reference numerals allocated to similar component parts of the beam projecting unit 1 are also shown in FIG. 3 although the following description is directed to that of the beam receiving unit 2.

The beam receiving unit 2 includes a casing 22 comprised of a mounting base 20 fixed to a wall surface or a support pole and the receiver cover 21 detachably supported by the mounting base 20. The receiver-side opening detecting switch 50 shown in and discussed with reference to FIG. 1 for detecting a physical opening of the receiver cover 21 is mounted fixedly on the mounting base 20. The receiver cover 21 is made of a material such as, for example, a synthetic resin of a kind capable of relatively favorably passing an infrared rays of light, but attenuating it by about 30% and is treated to represent a black color or a similar dark color sufficient to inhibit passage of visible rays of light therethrough.

The mounting base 20 has upper and lower spaced support members 28 and 29 fixed thereto so as to protrude perpendicular to the mounting base 20. A generally box-like receiver chassis 27 is swingably supported in between the upper and lower support members 28 and 29 by means of coaxially aligned vertical stud shafts 30 and 31. A generally rectangular lens holder 37 having coaxially aligned horizontal stud shafts 33 and 34 protruding laterally outwardly therefrom is accommodated within the receiver chassis 27 and is tiltably supported by opposite side walls of the receiver chassis 27 with the horizontal stud shafts 33 and 34 journalled thereto. Upper and lower beam receiving lenses 23 positioned one above the other are retained by a lens casing 24 which is in turn carried by the lens holder 37. A light receiving element (not shown) forming the beam receiver 11 in cooperation with the beam receiving lenses 23 is mounted on a printed circuit board (not shown) and is accommodated within the lens holder 37 and positioned at a location rearwardly of the beam receiving lenses 23.

Accordingly, it will readily be seen that the beam receiver 11 has an adjustable angle of swing in a horizontal direction, shown by the arrow h, as the receiver chassis 27 can be adjustably swung about a common axis defined by the vertical stud shafts 30 and 31 and also has an adjustable angle of tilt in a vertical direction, shown by the arrow v, as the lens holder 37 can be adjustably tilted about a common axis defined by the horizontal stud shafts 33 and 34, wherefore the optical axis can be aligned relative to the beam projector 11. As will be described in detail later, the optical axis alignment is carried out by the aid of a sighting instrument. Also, the sensor circuit of the circuit configuration shown in FIG. 1 is mounted on the printed circuit board referred to above, which is in turn mounted inside the lens holder 37. Thus, the sensor circuit is covered and protected by the receiver cover 21 through the lens holder 37.

One of the stud shafts, that is, the lower stud shaft 31 rotatably extends through the lower support member 29 and terminates with an adjustment knob 32 secured thereto for rotation together with the lower stud shaft 31 and, hence the receiver chassis 27 for adjustment of the angle of swing in the horizontal direction about the common axis defined by the upper and lower stud shafts 30 and 31. The receiver chassis 27 has a mounting flange 38 extending upwardly from a generally intermediate portion of a lower front edge of a lower wall of the receiver chassis 27, which flange 38 has an adjustment screw 39 turnably coupled thereto. This adjustment screw 39 is loosely through the mounting flange 38 and is then threaded into a projection 40 protruding downwardly from a lower end of the lens holder 37 so as to occupy a position behind the mounting flange 38. Accordingly, it will readily be seen that turn of the adjustment knob 32 results in adjustment of the angle of swing of the beam receiver 11 through the beam receiver chassis 27 and turn of the adjustment screw 39 results in adjustment of the angle of tilt of the beam receiver 11 through the lens holder 37.

It is to be noted that FIG. 3 illustrates a configuration wherein two structures each substantially similar to the beam receiving unit 2 shown in FIG. 1 are arranged one above the other and, therefore, the alarm generator circuit 17 can output the alarm signal when alarm signals are outputted from those paired beam receiving units 2.

A sighting instrument for aiding the optical axis adjustment is provided at a position substantially intermediate of the lens holder 37 with respect to the lengthwise direction thereof and generally between the beam receiving lenses 23. This sighting instrument 41 includes a pair of right and left viewing holes 43 and 44, a sighting hole 47 and 48 employed in association with each of the viewing holes 43 and 44, and a reflecting mirror employed in association with each of the viewing holes 43 and 44. This sighting instrument 41 can be operated in such a manner that while a servicing worker looks into one of the viewing holes 43 or 44, one or both of the adjustment knob 32 and the adjustment screw 39 have to be turned to adjust the angle of swing and/or the angle of tilt of the beam receiver 11 until an image of the beam projector 3 cast on the associated reflecting mirror aligns with an associated one of the sighting holes 47 or 48. In this way, the optical axes of the beam projecting and receiving units 1 and 2 can be aligned with each other. It is to be noted that the beam projector 3 shown in FIG. 1 has a physical structure similar to that of the beam receiver 11 discussed above.

To align the respective optical axes of the beam projecting and receiving units 1 and 2 with each other at the time of installation or servicing of the anti-thief security sensor assembly of the structure described above, when the projector cover 21A of the beam projecting unit 1 shown in FIG. 1 is physically opened, the physical opening of the projector cover 21A is detected by the projector-side opening detecting switch 7 and the transmission request generating circuit 8 operates in response to the detection by the opening detecting switch 7 to control the projector drive circuit 4. In this way, the projector drive circuit 4 controls the beam projector 3 so that the beam projector 3 can output the infrared beam IR superimposed with the received beam level transmission request signal B. On the other hand, in the beam receiving unit 2, even though the receiver cover 21 is physically not opened, the signal extracting circuit 53 extracts the received beam level transmission request signal B from the signal received by the beam receiver 11 and outputs the detection signal to the level output circuit 52. Then, in response to receipt of the detection signal the level output circuit 52 transmit the signal level of the detecting circuit 13, as a level display signal C indicative of the amount of the infrared beam received by the beam receiving unit 2, to the signal receiving unit 9 of the beam projecting unit 1. The signal receiving unit 9 of the beam projecting unit 1 subsequently causes the level meter 10 to display the level display signal C received by the signal receiving unit 9.

In view of the foregoing, when a single servicing worker is assigned to perform the optical axis alignment of the anti-thief security sensor assembly of the present invention, the servicing worker first has to physically open the projector cover 21A of the beam projecting unit 1 and then to turn the projector adjustment knob 32 and the projector adjustment screw 39, both in the beam projecting unit 1, one at a time while looking into one of the viewing holes 43 or 44 in the beam projecting unit 1 to thereby roughly align the optical axis of the beam projector 3 with the beam receiving unit 2 with naked eyes. Once this has been done, the servicing worker has to move to the site of installation of the beam receiver 11 where the servicing worker has to physically open the receiver cover 21 of the beam receiving unit 2 and then to turn the receiver adjustment knob 32 and the receiver adjustment screw 39, both in the beam receiving unit 2, one at a time while looking into one of the receiver viewing holes 43 or 44 in the beam receiving unit 2 to thereby roughly adjust the optical axis of the beam receiver 3.

Thereafter, by looking at the display made on the level meter 18 of the beam receiving unit 2, the servicing worker has to finely turn the adjustment knob 32 and the adjustment screw 39, both in the beam receiving unit 2, one at a time in a manner similar to that described above until the display on the level meter 18 indicates a maximum reading, thereby completing a fine adjustment of the optical axis of the beam receiver 11 to align exactly with that of the beam projector 3.

During the optical axis adjustment of the beam receiving unit 2, the opening detecting switch 50 detects the physical opening of the receiver cover 21 to thereby provide the received beam level suppressing circuit 51 with the detection signal. Accordingly, in response to the detection signal, the received beam level suppressing circuit 51 controls the gain of the amplifier circuit 12 through the AGC circuit 19 so that the signal level of the signal received by the beam receiver 11 can be lowered by 30% that corresponds to the amount of the infrared beam attenuated as the latter pass through the receiver cover 21. For this reason, even though the receiver cover 21 is physically opened, the level meter 18 displaying the output from the detecting circuit 13 in the beam receiving unit 2 displays the received signal at the same level as that exhibited when the receiver cover 21 is mounted. Accordingly, with the anti-thief security sensor assembly of the present invention, it is possible to accurately adjust the optical axis of the beam receiver 11 with only the receiver cover 21 of the beam receiving unit 2 opened physically. After the optical axis adjustment of the beam receiver 11 has been finished in this way, the receiver cover 21 is mounted to the original position.

Thereafter, the servicing worker has to return to the site of installation of the beam projecting unit 1 where by looking at the display made on the level meter 10 of the beam projecting unit 1, the servicing worker has to finely turn the adjustment knob 32 and the adjustment screw 39, both in the beam projecting unit 1, one at a time to perform a fine adjustment of the optical axis of the beam projector 3. When the display on the level meter 10 shows a reading higher than the predetermined level, it means that the optical axis of the beam projector 3 is exactly aligned with that of the beam receiver 11 and, accordingly, the projector cover 21A of the beam projecting unit 1 is then mounted to the original position, thereby completing the optical axis alignment between the beam projecting and receiving units 1 and 2. Since at this time the receiver cover 21 of the beam receiving unit 2 has already been mounted to the original position, the servicing worker need not again move to the site of installation of the beam receiving unit 2. Thus, it will readily be seen that only one round trip between the site of installation of the beam projecting unit 1 and the site of installation of the beam receiving unit 2 is needed for the servicing worker to accomplish the required optical axis alignment.

Although during the optical axis adjustment of the beam projecting unit 1, only the projector cover 21A of the beam projecting unit 1 is physically opened, the received beam level suppressing circuit 51 controls through the AGC circuit 19 to reduce the signal level of the signal received by the beam receiver 11 by 30%. Accordingly, even though the projector cover 21A is physically opened, the amount of the infrared beam received by the beam receiving unit 1 can be displayed by the level meter 10 of the beam projecting unit 1 at the same signal level as the signal level attained when the projector cover 21A is mounted and, therefore, the alignment of the respective optical axes of the beam projecting and receiving units 1 and 2 can easily be achieved. Thus, with the anti-thief security sensor assembly according to the present invention, even though the receiver cover 21 of the beam receiving unit 2 is not opened physically, only physical opening of the projector cover 21A of the beam projecting unit 1 is sufficient to achieve the alignment of the optical axis of the beam projector 3.

Also, when both of the projector and receiver covers 21A and 21 of the beam projecting and receiving units 1 and 2 are physically opened, the received beam level suppressing circuit 51 operates, in response to receipt of the detection signal from the opening detecting switch 50 and the detection signal from the signal extracting circuit 53, to control the gain of the amplifier circuit 12 through the AGC circuit 19 so that the signal level of the beam receiver 11 can be reduced by 60% that corresponds to the amount of the infrared beam attenuated as it pass through both of the projector and receiver covers 21A and 21. Accordingly, even in this case, the received beam signal can be displayed on the level meter 18 or the level meter 10 at the same level as that exhibited when the projector and receiver covers 21A and 21 are mounted on the respective bases. Thus, regardless of whether one or both of the projector and receiver covers 21A and 21 are opened physically, the accurate alignment of the respective optical axes of the beam projector 3 and receiver 11 with each other can be achieved.

It is to be noted that in the foregoing description of the preferred embodiment of the present invention, the received beam level transmission request signal B has been described as superimposed on the infrared beam IR before it is emitted from the beam projector 3 so that the received beam level transmission request signal B can be transmitted with no extra need to employ any communicating means between the beam projecting and receiving units 1 and 2. However, for the transmitting means for transmitting the received beam level transmission request signal B, a wireless wave transmitter or an optical signal output device may be provided in the beam projecting unit 1 together with a wave receiver or an optical signal receiver provided in the beam receiving unit 2. Also, in place of or in combination with the level meter 18, only the beam receiving unit 2 may be provided with, as a level output device, a light emitting device using a plurality of light emitting elements such as light emitting diodes (LED) which light-emit different colors according to the varying amount of the received beam, so that a beam of a certain color depending on the amount of the received beam can be emitted therefrom towards the beam projecting unit 1 as the level display signal C. In such case, the servicing worker looking at the level output device can recognize the signal level in reference to the color of the signal emitted therefrom.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. An anti-thief security sensor assembly which includes:

a beam projecting unit for projecting an infrared beam, said beam projecting unit including a base having a sensor circuit mounted thereon and a projector cover detachably mounted on the base for enclosing and projecting the sensor circuit; and a beam receiving unit for receiving the infrared beam projected by the beam projecting unit and operable to detect a human body in the event that the human body traverses the optical path of travel of the infrared beam from the beam projecting unit towards the beam receiving unit, and further including a level output circuit;

said beam projecting unit also including an opening detecting switch for detecting a physical opening of the projector cover and a transmission request generating circuit operable in response to the detection of the physical opening of the projector cover by the opening detecting switch for outputting a received beam level transmission request signal to the beam receiving unit;

said level output circuit being operable in response to receipt of the received beam level transmission request signal to transmit to the beam projecting unit a level display signal indicative of the amount of the infrared beam received by the beam receiving unit.

2. The anti-thief security sensor assembly as claimed in claim 1, wherein the transmission request generating circuit is operable to superimpose the received beam level transmission request signal on the infrared beam emitted from the beam projecting unit.

3. The anti-thief security sensor assembly as claimed in claim 1, wherein the opening detecting switch concurrently serves as a tamper switch for detecting a nuisance opening of the projector cover.

4. The anti-thief security sensor assembly as claimed in claim 1, wherein the infrared beam is a pulse modulated light and the received beam level transmission request signal is a pulse signal of a frequency different from that of the infrared beam.

5. The anti-thief security sensor assembly as claimed in claim 1, wherein the beam receiving unit further includes an amplifier for amplifying the infrared beam received by the beam receiving unit, and a received beam level suppressing circuit for controlling the amplifier to reduce the amplified beam level by a predetermined level corresponding to the amount of the infrared beam attenuated as it passes through the projector cover of the beam projecting unit.

* * * * *